US011414949B2

(12) United States Patent
Rao

(10) Patent No.: US 11,414,949 B2
(45) Date of Patent: Aug. 16, 2022

(54) DEEPWATER RISER INTERVENTION SYSTEM

(71) Applicant: WORLDWIDE OILFIELD MACHINE, INC., Houston, TX (US)

(72) Inventor: Reddi Udaya Bhaskara Rao, Cypress, TX (US)

( * ) Notice: Subject to any disclaimer, the term of this patent is extended or adjusted under 35 U.S.C. 154(b) by 63 days.

(21) Appl. No.: 16/831,188

(22) Filed: Mar. 26, 2020

(65) Prior Publication Data

US 2020/0332616 A1 Oct. 22, 2020

Related U.S. Application Data

(60) Provisional application No. 62/835,715, filed on Apr. 18, 2019.

(51) Int. Cl.

| | |
|---|---|
| ***E21B 47/14*** | (2006.01) |
| ***E21B 47/07*** | (2012.01) |
| ***E21B 33/035*** | (2006.01) |
| ***E21B 17/08*** | (2006.01) |

(52) U.S. Cl.

CPC ..... *E21B 33/0355* (2013.01); *E21B 17/085* (2013.01); *E21B 47/14* (2013.01); *E21B 47/07* (2020.05)

(58) Field of Classification Search

None

See application file for complete search history.

(56) References Cited

U.S. PATENT DOCUMENTS

| | | | |
|---|---|---|---|
| 4,081,027 | A | 3/1978 | Nguyen et al. |
| 4,215,749 | A | 8/1980 | Dare et al. |
| 4,230,299 | A | 10/1980 | Pierce, Jr. |
| 4,590,823 | A | 5/1986 | Nevesm et al. |
| 4,668,126 | A | 5/1987 | Burton |
| 4,671,312 | A | 6/1987 | Bruton |
| 4,827,963 | A | 5/1989 | Baker et al. |
| 4,878,651 | A | 11/1989 | Meyer, Jr. |
| 4,886,115 | A | 12/1989 | Leggett et al. |
| 4,921,207 | A | 5/1990 | Baker |
| 4,997,162 | A | 3/1991 | Baker et al. |
| 5,501,424 | A | 3/1996 | Williams et al. |
| 5,803,431 | A | 9/1998 | Hoang et al. |

(Continued)

*Primary Examiner* — Matthew Troutman
*Assistant Examiner* — Douglas S Wood
(74) *Attorney, Agent, or Firm* — Kenneth L. Nash; Thomas D. Nash

(57) ABSTRACT

The present invention discloses apparatus and methods for a lightweight subsea intervention package. In one embodiment, the system comprises a lower riser package for controlling the subsea well which utilizes a plurality of hydraulically activated well barriers. An emergency disconnect package is secured to the lower riser package and is electrically connected to the lower riser package. The emergency disconnect package is operable to seal the bottom of a riser and minimize environmental leakage of fluid from the riser. The lower riser package and emergency disconnect package each contain a closed loop system of fluid operable to control the system without fluid from the surface. Each is operable to control the well barriers. Either an electrical connection or an acoustic control system may be utilized to control the system. The lower riser package can be operated from the surface when the emergency disconnect package has been disconnected.

12 Claims, 7 Drawing Sheets

(56) References Cited

U.S. PATENT DOCUMENTS

| | | | | |
|---|---|---|---|---|
| 5,845,708 | A | 12/1998 | Burge et al. | |
| 5,894,771 | A | 4/1999 | Braun et al. | |
| 5,938,175 | A | 8/1999 | Young et al. | |
| 6,041,804 | A | 3/2000 | Chatufale | |
| 6,109,353 | A | 8/2000 | Edwards | |
| 6,209,650 | B1 | 4/2001 | Ingebrigtsen et al. | |
| 6,223,825 | B1 | 5/2001 | Ingebrigtsen et al. | |
| 6,260,822 | B1 | 7/2001 | Puranik | |
| 6,457,370 | B1 | 10/2002 | Okano | |
| 6,601,650 | B2 | 8/2003 | Sundararajan | |
| 6,684,897 | B2 | 2/2004 | Sundararajan | |
| 6,966,537 | B2 | 11/2005 | Sundararajan | |
| 7,013,970 | B2 | 3/2006 | Collie et al. | |
| 7,040,408 | B2 | 5/2006 | Sundararajan | |
| 7,578,349 | B2 | 8/2009 | Sundararajan | |
| 7,849,926 | B2 | 12/2010 | Inderberg | |
| 9,732,576 | B2 | 8/2017 | Rao | |
| 9,845,652 | B2 * | 12/2017 | Wolfe | E21B 29/00 |
| 10,006,266 | B2 | 6/2018 | Sundararajan | |
| 10,704,352 | B2 * | 7/2020 | Lycke | E21B 44/00 |
| 2018/0073320 | A1 * | 3/2018 | Holmes | F15B 1/02 |
| 2019/0226296 | A1 * | 7/2019 | Rakhunde | E21B 33/0355 |

* cited by examiner

DEEPWATER RISER INTERVENTION SYSTEM

BACKGROUND

The present invention relates generally to subsea intervention systems and, more particularly, to a deepwater riser intervention system.

Often subsea wells do not perform at/to the same levels of performance as platform wells mainly due to the high costs of servicing subsea wells, which may be referred to herein as subsea well interventions. The subsea well Christmas tree, also referred to herein as a production tree, may typically be either a vertical production tree or a horizontal production tree.

A subsea intervention package preferably provides a means for connecting the various types of subsea trees to perform workover operations while still maintaining control over the subsea well. If necessary, a subsea intervention package should provide means to isolate and seal the well in emergency situations, e.g., if a dynamically positioned drilling ship or unanchored semi-submersible platform loses the ability to maintain its position above the subsea well. Emergency disconnect systems should preferably be able to reliably sever any tubing and/or wireline that extends through the Christmas tree and then seal and isolate the well in case it is necessary to disconnect from the well due to an emergency. Prior art systems may be slow to operate to perform these functions and may sometimes allow significant amounts of fluid leakage before isolation is accomplished. It would be more desirable to provide a more effective and environmentally-friendly subsea intervention package.

A commonly utilized subsea intervention package for well completions comprises a high pressure riser system in combination with a subsea drilling BOP and a marine riser for access to the well. This system is very heavy and bulky. A subsea drilling BOP intervention system may weigh in the range of 500,000 to 1,000,000 pounds. The system may often require the capabilities of a semi-submersible platform, which may be of the type requiring anchors, to lower and raise the intervention package. Accordingly, the time to move the platform to location and set the anchors is rather long. The bulky system must also be lowered, installed, and then removed. The overall cost of the intervention operation utilizing a subsea drilling BOP intervention system is quite high, but the system provides the means for doing any type of desired work. Other attempts to produce lightweight systems have limitations that make them unsuitable for some types of intervention work.

The following patents discuss background art related to the above discussed subject matter including examples of intervention system assemblies and are hereby incorporated by reference:

U.S. Pat. No. 7,040,408 issued to Worldwide Oilfield Machine, Inc., discloses a flowhead for a well testing system and is incorporated herein by reference. The well testing system comprises a plurality of threaded connection pipes extending from the surface to a subterranean zone of interest which is isolated for testing purposes. Fluid flows from the subterranean zone in the flowhead and is directed to a flare and related measuring instrumentation. The flowhead includes a swab inlet with a swab valve, a kill line with an associated valve and a flow line with an associated valve. The line connecting directly to the well preferably comprises an outer swivel element integral with a body of the flowhead and a roller bearing supported inner swivel element rotatably mounted therein.

U.S. Pat. No. 7,578,349 issued to Worldwide Oilfield Machine, Inc., which is incorporated herein by reference, discloses an apparatus and methods for a lightweight subsea intervention package that may be installed using vessels with a smaller lifting capacity than semi-submersible platforms so that the subsea intervention package can be transported, installed, and removed from a subsea well in less time and with less cost. In one embodiment, the invention comprises a lower riser package for controlling the subsea well which utilizes two hydraulically activated gate valves. An emergency disconnect package is secured to the lower riser package utilizing a disconnect mechanism. The emergency disconnect package is operable to seal the bottom of a riser if the disconnect mechanism is activated to thereby minimize environmental leakage of fluid from the riser.

U.S. Pat. No. 10,006,266 issued to Worldwide Oilfield Machine, Inc., which is incorporated herein by reference, discloses an apparatus and method for a lightweight subsea intervention package that may be installed using vessels with a smaller lifting capacity than semi-submersible platforms so that the subsea intervention package can be transported, installed, and removed from a subsea well in less time and with less cost. In one embodiment, the present invention comprises a lower riser package for controlling the subsea well which utilizes two hydraulically activated gate valves. An emergency disconnect package is secured to the lower riser package utilizing a disconnect mechanism. The emergency disconnect package is operable to seal the bottom of a riser if the disconnect mechanism is activated thereby minimizing environmental leakage of fluid from the riser.

U.S. Pat. No. 6,601,650 issued to Worldwide Oilfield Machine, Inc., which is incorporated herein by reference, discloses an apparatus and method for replacing a BOP with a gate valve to thereby save space, initial costs, and maintenance costs that is especially beneficial for use in offshore subsea riser packages. The method provides a gate valve capable of reliably cutting tubing utilizing a cutting edge with an inclined surface that wedges the cut portion of the tubing out of the gate valve body. A method and apparatus is provided for determining the actuator force needed to cut the particular size tubing.

U.S. Pat. No. 9,732,576, issued to Worldwide Oilfield Machine, Inc., which is incorporated herein by reference, discloses a compact lightweight cutting system with two gates with cutters moveable in opposite directions to cut drill pipe. The system utilizes a relatively short stroke and relatively less hydraulic ail Control fluid for subsea operation. An opening through the gates surrounds the wellbore in the open position. The cutting elements are mounted within the openings. The piston rods and pistons are vertically offset with respect to each other. The compact cutting system with a gate valve can be used to substitute for a BOP to significantly reduce the size and weight required in an intervention system.

Consequently, those skilled in the art will appreciate the present invention that addresses the above problems with a lightweight and compact subsea intervention package that can be transported, installed, and then removed from a subsea well more quickly to provide a wide range of operations, and which is operable to cut and seal any working strings therein in a fail-safe mode.

SUMMARY OF THE INVENTION

An objective of the present invention is to provide an improved deepwater riser intervention package.

Another objective of the present invention is to provide a deepwater riser system with a subsea hydraulic power unit to control the system.

Yet another object of the present invention is to provide a closed loop control system thereby removing the need to supply any hydraulic pressure and supply from a rig or other source.

Another object of the present invention is to provide a lower riser package and emergency disconnect package which can be controlled independently.

Still another object of the present invention is to provide a lower riser package which can be controlled from a rig even after disconnecting the emergency disconnect package.

Yet another object of the present invention is to provide at least three well barriers in the lower riser package to ensure the cutting and sealing of tubulars in the wellbore.

Yet another object of the present invention is to convert a Riser Intervention system into Riser-less Intervention system and vice-versa on a rig.

One general aspect includes a riser intervention system for subsea applications. A wellbore extends through the riser intervention system including a surface control. An emergency disconnect package has a first control. The first control includes a first hydraulic power unit. The first hydraulic power unit includes a first hydraulic fluid reservoir and a first hydraulic pump. The first control is electrically connectable to the surface control. A first battery is provided the first control to provide power when the first control is not electrically connected to the surface control. The first hydraulic fluid reservoir and the first hydraulic pump are a closed loop system that is not hydraulically connected to the surface control. A first well barrier is provided for cutting and sealing functions on a first portion of the wellbore through the emergency disconnect package. A lower riser package is connectable to the emergency disconnect package. The lower riser package is selectively disconnectable from the emergency disconnect package. The lower riser package includes a second control including a second hydraulic power unit. The second hydraulic power unit has a second hydraulic fluid reservoir and a second hydraulic pump. The second control is electrically connectable to the surface control and the first control. A second battery for the second control is provided to provide power when the second control is not electrically connected to the surface control or the first control. The second hydraulic fluid reservoir and the second hydraulic pump is a closed loop system that is not hydraulically connected to the surface control or the first hydraulic power unit. Second, third and fourth well barriers are provided for cutting and sealing functions on a second portion of the wellbore through the lower riser package. The emergency disconnect package and the lower riser package is connectable without using hydraulic couplers.

Implementations may include one or more of the following features where the riser intervention system further has an acoustic control system including a surface acoustic transmitter. A first acoustic receiver for the emergency disconnect package is operable to send signals to the first control when the first control is not electrically connected to the surface control. An acoustic control system includes a surface acoustic transmitter. A second acoustic receiver for the lower riser package is operable to send signals to the second control when the second control is not electrically connected to the surface control. The riser intervention system further includes electrical feeds between the emergency disconnect package and the lower riser package when the emergency disconnect package is connected to the lower riser package. The surface control is operable to selectively operate either the first control or the second control or both. The surface control is operable to operate the second control whether the emergency disconnect package is attached or not attached to the lower riser package. When the emergency disconnect package is secured to the lower riser package, then the first control can operate the second control or the second control can operate the first control. The riser intervention system further includes a first umbilical termination head to electrically connect the surface control to the first control. A second umbilical termination head may electrically connect the surface control to the second control. An ROV is operable to connect an umbilical to the second umbilical termination head when the emergency disconnect package is separated from the lower riser package. The riser intervention system further includes a sensor control unit including at least one sensor of a pressure sensor, a temperature sensor, a flow meter, or a combination thereof. At least one sensor is operable to operate whether or not the emergency disconnect package is connected to the lower riser package. The emergency disconnect package and the lower riser package may include programming operable to operate the first control and the second control when no signal is received by the emergency disconnect package and the lower riser package from the surface control.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages.

BRIEF DESCRIPTION OF THE DRAWINGS

The following detailed description and claims are merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein:

DETAILED DESCRIPTION

Figure 1:
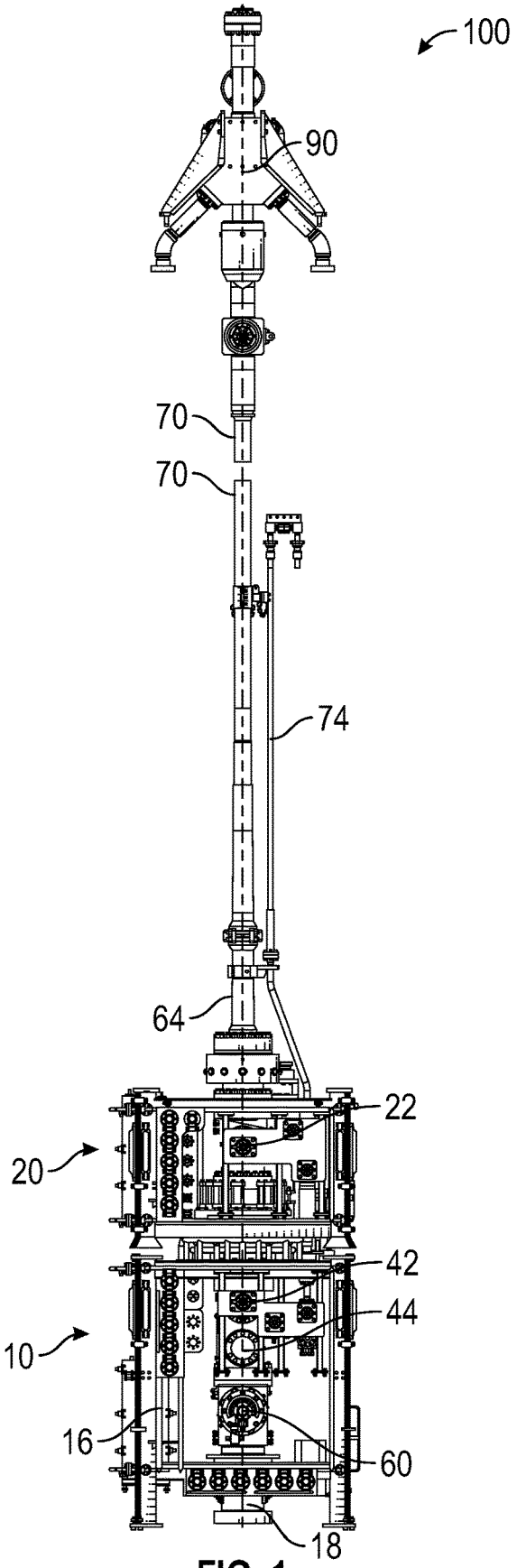
FIG. 1 is a front elevational view of a deepwater riser intervention system in accord with one embodiment of the present invention.
Figure 2:
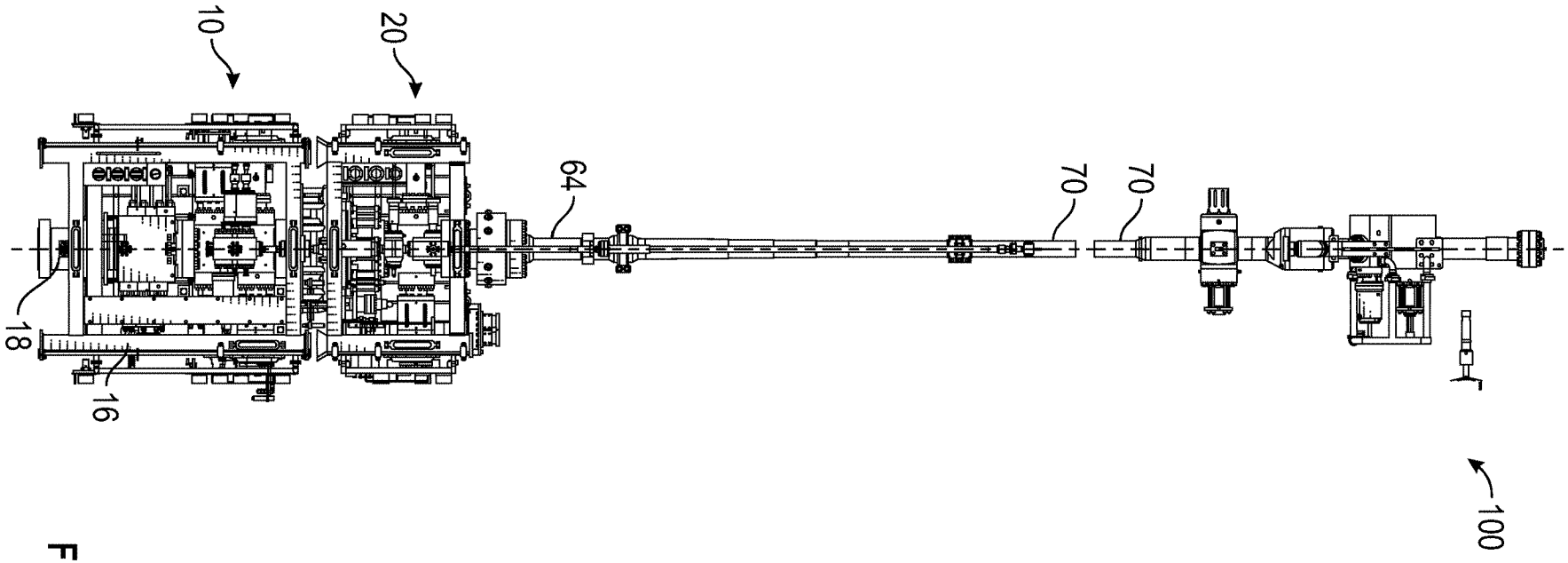
FIG. 2 is a side elevational view of a deepwater riser intervention system in accord with one embodiment of the present invention.
Figure 3:
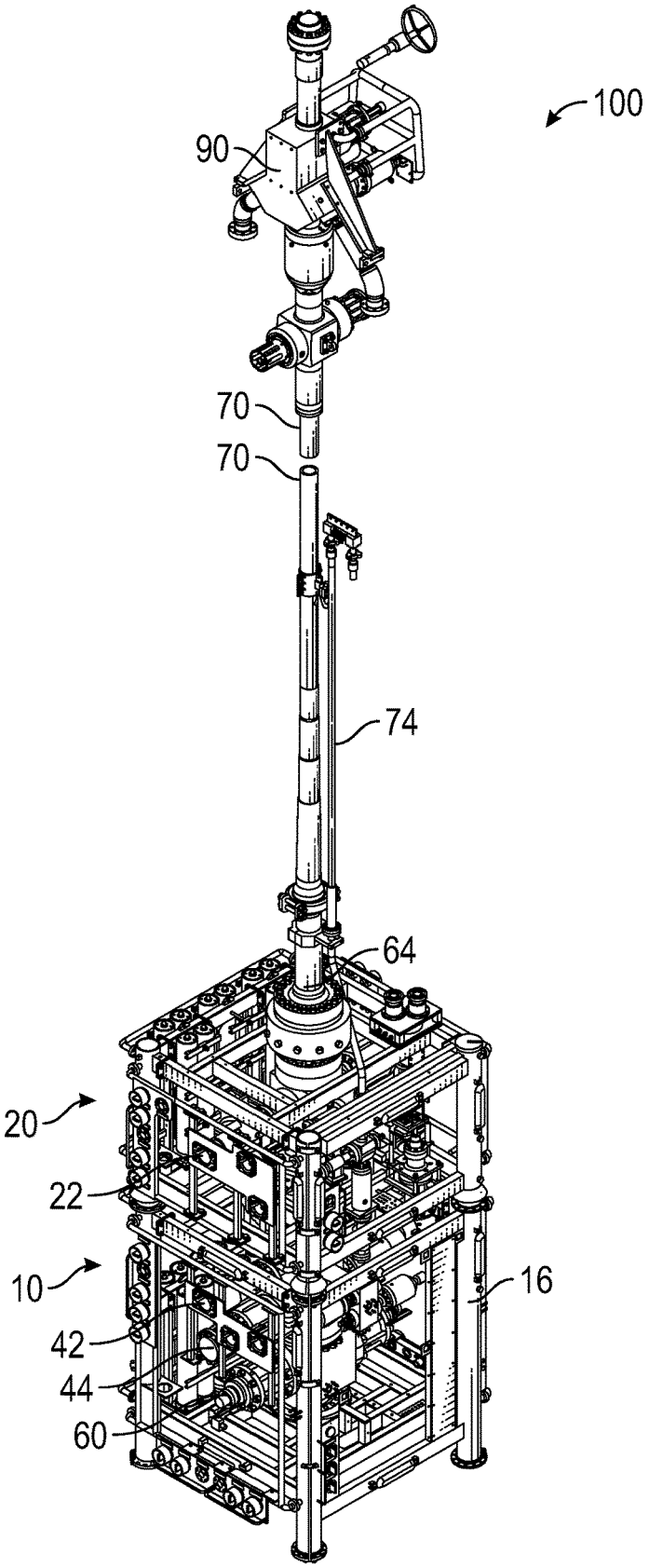
FIG. 3 is an isometric view of a deepwater riser intervention system in accord with one embodiment of the present invention.
Figure 4:
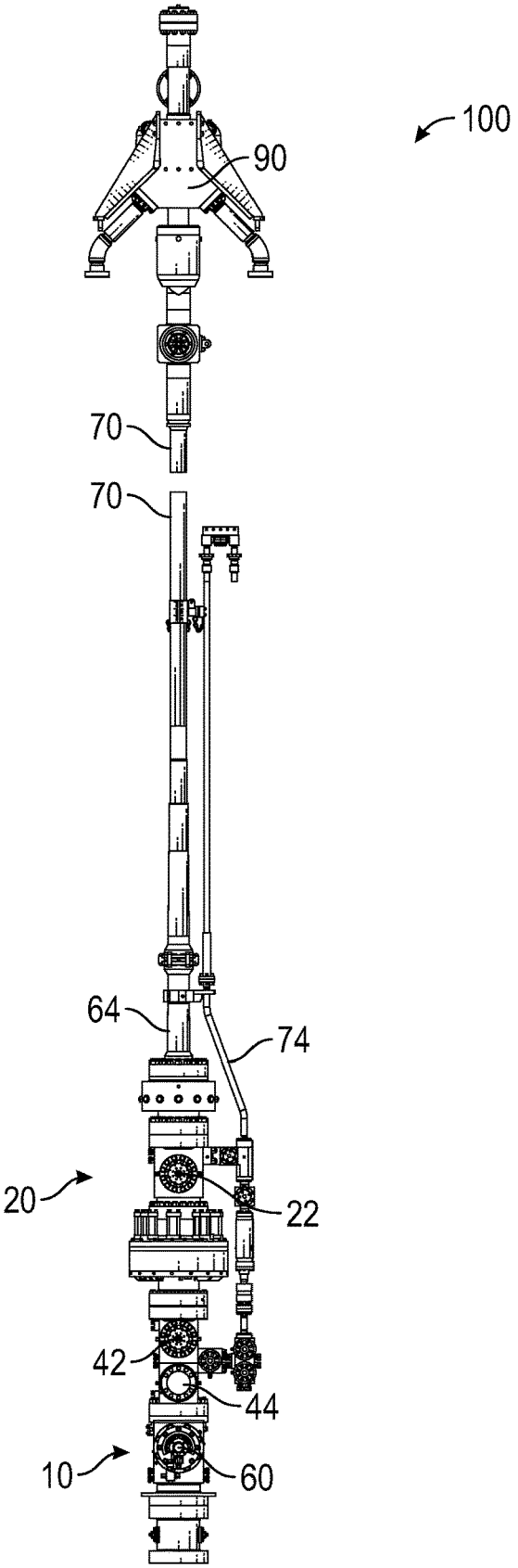
FIG. 4 is another elevational view (skeleton view) of a deepwater riser intervention system in accord with one embodiment of the present invention.
Figure 5:
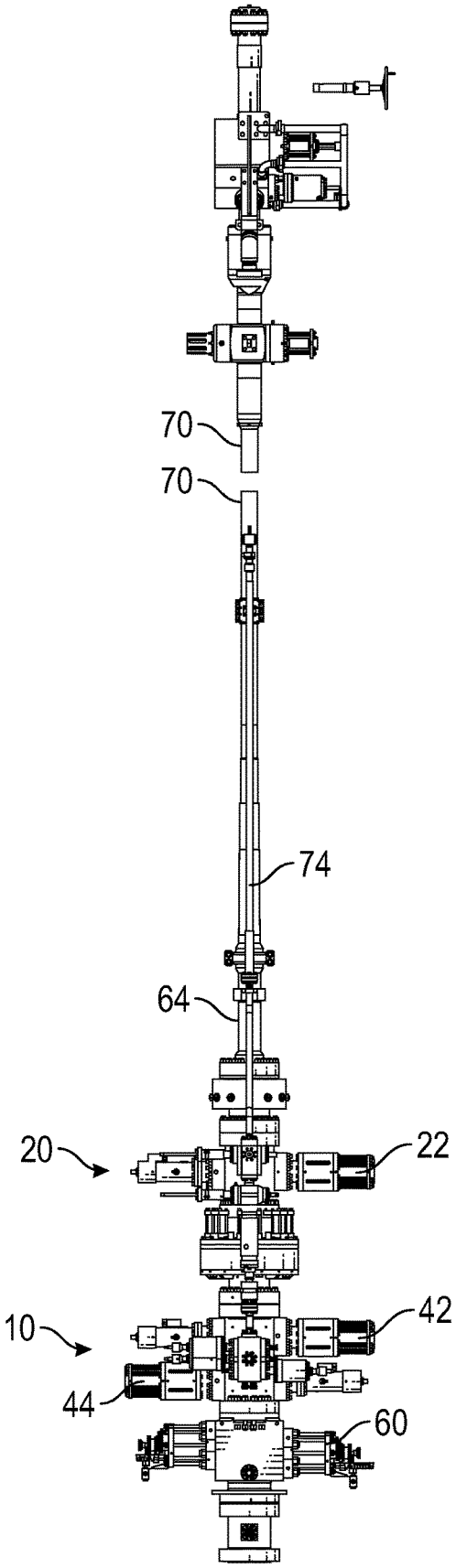
FIG. 5 is yet another elevational view (skeleton view) of a deepwater riser intervention system in accord with one embodiment of the present invention.

Referring now to the drawings, and more particularly to FIG. 1, there is shown one embodiment of deepwater riser intervention system 100, in accord with the present invention. Intervention system 100 is preferably mountable to a standardized frame such as adaptor frame 16 and uses spool adaptor 18. Adaptor frame 16 may be provided at the subsea wellhead and/or be provided to establish an interface with the subsea well. It will be noted that the present invention is virtually contained within these dimensions with no components jutting significantly outwardly from these dimensions. Deepwater Riser System (DRS) 100 preferably takes advantage of any existing standardized connection means for quick installation. In operation, an ROV (remotely operated vehicle) may guide the frame sockets into alignment with frame posts and/or may help with the subsea intervention package deployment in other suitable ways.

The following Acronyms and Abbreviations may be used herein:

Subsea HPU: Hydraulic Power unit
LRP: Lower Riser Package
EDP: Emergency Disconnect Package
IRS system: Intervention Riser system
SCM A & SCM B: Subsea Control Module
DRS: Deepwater Riser Intervention System
BATT: Battery
EDP Block: Emergency Disconnect Package Block
EDP connector: Emergency Disconnect Package Connector
LRP Dual Block: Lower Riser Package Dual Block
ROV: Remotely Operated Vehicle
SCM: Subsea control module
SDU: Subsea Distribution Unit
DCV: Direction control valves
PWRS: Power supply module
UTH: Umbilical termination head
SCU: Surface control unit
CCD: Compact cutting device Intervention system 100 is comprised of two main components, lower riser package (LRP) 10 and emergency disconnect package (EDP) 20. In one embodiment, the EDP 20 is lowered onto the LRP 10 and secured into place. In other embodiments, each package may be already assembled prior to lowering into place. Electrical connections connect the LRP and EDP allowing signals to be sent to each for controlling the various systems therein. An EDP connector may be utilized to physically connect the EDP 20 and LRP 10.

Within the EDP 20 is EDP block 22. EDP block 22 contains a gate valve for cutting tubulars within the wellbore when desired or necessary. Cutting the pipe or tubing may be desirable in instances such as inclement weather, performing workovers, or in emergency situations thereby cutting the tubular in place and sealing the pipe so that fluid does not leak into the water. A suitable gate valve cutter is provided in one or more of the patents discussed above that are all incorporated herein by reference.

The EDP 20 may be connected to the riser formed of multiple riser tubulars 70 utilizing a stress joint 64. Stress joint 64 of deepwater riser intervention system 100 is utilized to absorb most of the bending forces that exist at lower side of deepwater riser intervention system 100, e.g., due to ocean currents, waves, movement of a dynamically positioned vessel, and the like. A flowhead assembly 90 may be provided at the surface connecting to the multiple riser tubulars 70 for well testing fluid flow of interest. A possible embodiment of flowhead 90 is further described in U.S. Pat. No. 7,040,408 and is hereby incorporated by reference.

An annulus line 74 may also be connected to the intervention package 100 thereby allowing fluid to be pumped from the well. The annulus 74 gives the ability to circulate fluid in the well. The annulus 74 may also be secured to multiple riser tubulars 70 and follows the riser up to the surface.

Lower riser package (LRP) 10 in one embodiment may be mounted below emergency disconnect package (EDP) 20. Within LRP 10 may be a series of valve cutters that can be utilized to cut any tubing or piping within the well and seal fluid from leaking. The valves comprise upper control valve 42, lower control valve 44, and compact cutting device 60. These valves comprise three separate well barriers to ensure proper sealing in the event sealing is desired or necessary. In other embodiments, greater or fewer valves may be equipped. The valves or valve cutters may be of the type described by the patents discussed previously all of which are incorporated herein by reference.

EDP 20 comprises EDP block 22 wherein a valve is provided. This valve may be a gate valve which is operable to close off the bottom of the riser to prevent leaking fluid into the environment such as the ocean. The gate valve may also be utilized to cut any pipe or wireline going through the valve. The valves or valve cutters may be of the type described by the patents discussed above.

Turning to FIGS. 2-5, Deepwater Riser System 100 is shown from various other perspectives. CCD 60 is the primary cutting and sealing device in the LRP 10 along with two well bore barriers in upper control valve 42 and lower control valve 44. By integrating CCD 60 into LRP 10, the overall system weight, height and total number of units in a system is reduced while providing additional cutting and sealing device along with two separate barriers. Stress joint 64 of deepwater riser intervention system 100 is utilized to absorb most of the bending forces that exist at lower side of deepwater riser intervention system 100, e.g., due to ocean currents, waves, movement of a dynamically positioned vessel, and the like. Other various elements (not shown) may be used for supporting deepwater riser intervention system 100 such as a riser spider, lubricator valve cross-over, lubricator valve, swivel assembly/flow head assembly.

Each gate valve preferably comprises an actuator and a manual override actuator. The manual override actuator(s) may be operated by a ROV. The manual override may be located on an opposite side of the mono block from the corresponding hydraulic actuator. This symmetrical construction significantly reduces the overall size and weight of the gate valves. In a preferred embodiment, the gate valve operator can be removed for service without removing the valve bonnet. A valve position indicator is provided that is viewable from all sides by an ROV. Various types of indicators may be utilized to indicate the position of the manual override operator and/or the position of the actuator as discussed in the aforementioned patents. Upper gate valve 42 and lower gate valve 44 preferably each comprise a specially profiled slidable gate operating with special seal assemblies which provide the capability of cutting wireline such as braided cable or slick line as described in more detail in the aforementioned patents. Upper and lower gate valves 42 and 44 may also be utilized to cut Wireline and coiled tubing as discussed in more detail in the aforementioned patents. Upper and lower gate valves 42 and 44 are each individually moveable between an open position and a closed position whereby fluid flow through conduit or wellbore may be controlled.

Figure 6:
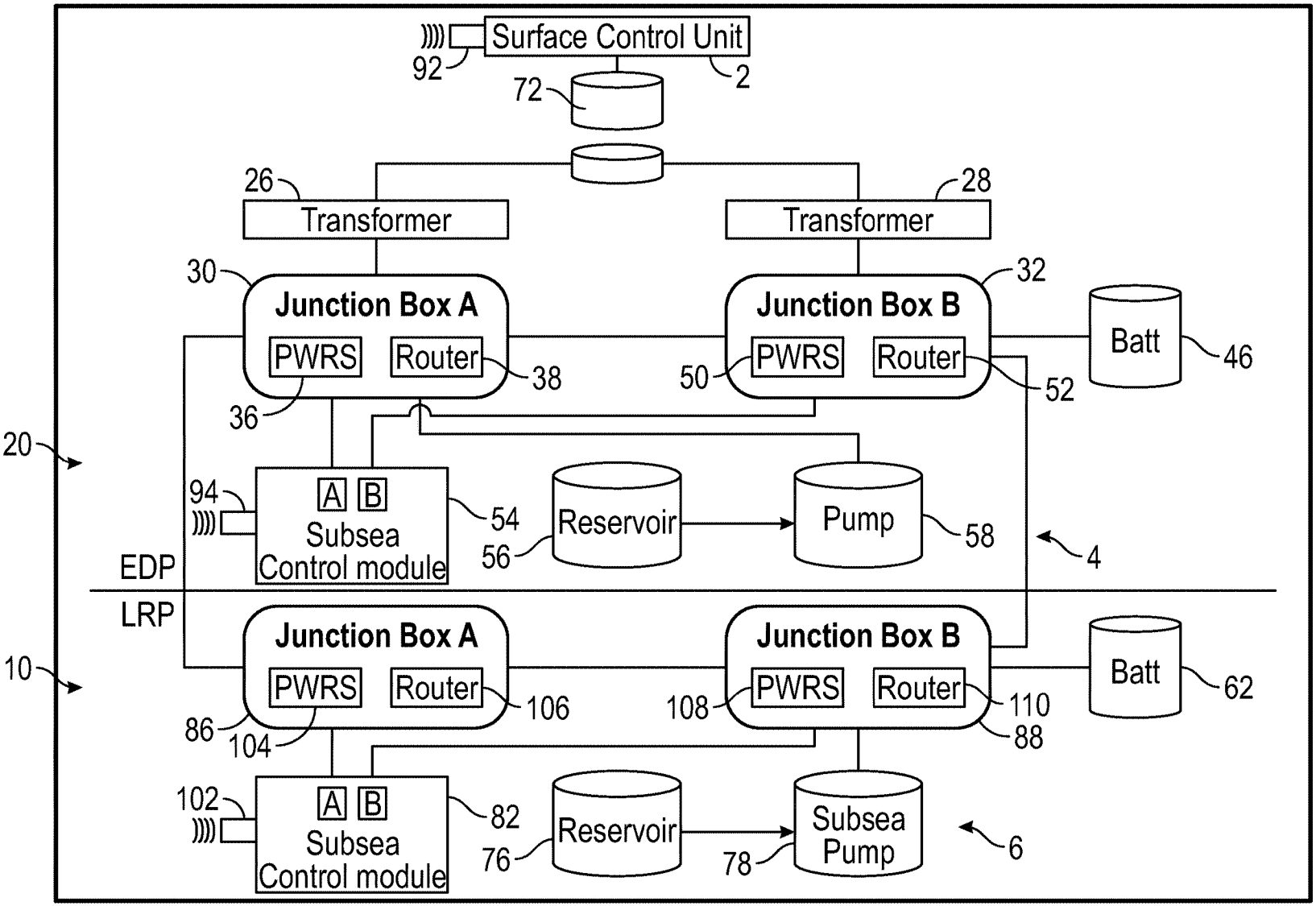
FIG. 6 is a flow chart depicting a block diagram of a deepwater riser intervention control system in accord with one embodiment of the present invention.

Referring to FIG. 6, a flow chart is shown depicting a block diagram of a deepwater riser intervention control system in accord with one embodiment of the present invention.

Within intervention system 100 are subsea reservoirs and pumps wherein hydraulic fluid supply from a rig is unnecessary. In other words, EDP 20 and LRP 10 each contain their own respective hydraulic fluid reservoir and pumps. This will reduce the reaction time for deepwater riser system (DRS) functions. Additionally, the total foot print is greatly reduced on the rig due to the absence of hydraulic fluid supply to the umbilical so that it is much smaller compared to any other system in market.

Intervention system 100 comprises a closed loop hydraulic control system. Therefore, this provides the benefit of having no environmental impact at the working location. Control fluid will not to be vented in to the sea as in other systems used in the market.

Again referring to FIG. 6, surface control unit (SCU) 2 may be positioned on a rig aboard a floating vessel or ship. The surface control unit 2 is utilized to send and receive signals to the EDP 20 and LRP 10 to operate EDP 20 and LRP 10. This signal may be sent through an umbilical from the surface with intervention system 100, through an acoustic system, or connected through use of an ROV.

The EDP 20 may comprise two transformers 26, 28. The transformers may be similar to any power supply transformer but with an application to subsea systems. The transformers may be contained within a transformer canister. Transformer 26 is connected to junction box A 30. The junction box 30 may be utilized for all communication and power to the system. The junction boxes may also be referred to as subsea distribution units (SDUs). Junction box A 30 contains power supply module (PWRS) 36 that utilizes power from transformer 26 and router 38. Transformer 28 is connected to junction box B 32 which contains power supply module 50 and router 52. Routers within the junction boxes convert signals to be suitable for use between the umbilical and subsea equipment. Junction box A 30 and junction box B 32 are also connected to each other allowing signals to be sent from both boxes or for redundancy. Either junction box 30, 32 may be utilized in the event the other is damaged, malfunctioning or otherwise unable to operate thereby creating a redundancy to allow continuous operation. Utilizing at least two junction boxes provides for additional safety of operational control in the system by providing a backup system in the event it may be necessary.

Within EDP 20 is a battery 46. Battery 46 is operable to provide power in the event the umbilical is disconnected. The battery 46 may be able to provide continuous power for approximately twenty four hours, however it may be able to provide more or less depending on the conditions, type of battery, amount of use, and the like. Battery 46 is connected to junction box B 32 which is also connected to junction box A 30 thereby allowing power to be dispersed to either junction box and throughout EDP 20.

A subsea control module (SCM) 54 is housed within EDP 20. The SCM may also be referred to as mCM. SCM 54 is further connected to both junction boxes 30, 32. SCM 54 controls the operation of EDP 20. The SCM may be a computer operable for sending the desired signal during operation of the EDP 20. The subsea control modules in general contain a plurality of output functions to control operation of the EDP and LRP on a command signal sent from the junction box. SCM 54 is also connected to hydraulic power unit (HPU) 4. HPU 4 is comprised of a self-contained hydraulic fluid reservoir 56 and pump 58. Therefore, as stated above, EDP 20 contains its own source of fluid, is a closed loop hydraulic fluid system, and does not need externally provided fluid from the surface. This provides the benefit of faster operation, not requiring additional pipes or lines lowered with system 100, no need for refilling from the top-side, and avoiding possible contamination of the environment from leaking such as in the event the hydraulic line is severed or the like.

The EDP 20 is preferably electrically but not hydraulically connected to LRP 10 during normal operation. EDP 20 may send signals to control the LRP 10 when system 100 is not electrically connected to surface control unit 2. Alternatively, LRP 10 may control EDP 20.

LRP 10 is also operable to control the cutter valves discussed above to cut pipe or wireline going through it and seal the well. LRP 10 may be controlled from the surface control unit 2 through use of an umbilical line. LRP 10 may comprise junction box A 86 and junction box B 88. Junction box 86, 88 are connected together similarly to junction boxes 30, 32. Additionally, both sets of junction boxes 30, 32 and 86, 88 may all be connected together. Therefore, power and operational signals may be provided to either EDP 20 or LRP 10 from the other respective package. Junction box A 86 contains power supply module (PWRS) 104 and router 106. Junction box B 88 contains power supply module 108 and router 110. Battery 62 is connected to junction box B 88 which is also connected to junction box A 86 thereby allowing power to be dispersed to either junction box and throughout LRP 10 similar to the EDP 20 described above.

A subsea control module (SCM) 82 is housed within LRP 10. SCM 82 is further connected to both junction boxes 86, 88. SCM 82 controls the operation of LRP 10. SCM 82 is also connected to hydraulic power unit (HPU) 6. HPU 6 is comprised of a reservoir 76 and pump 78. Therefore, as stated above, LRP 10 contains its own source of fluid or closed loop system and does not need externally provided hydraulic fluid from the surface. This provides the benefit of faster operation, not requiring additional pipes or lines lowered with system 100, no refilling from the top-side, and avoiding possible contamination of the environment from leaking such as in the event the hydraulic line is severed or the like. By closed loop hydraulic system in each of the LRP and EDP, as used herein, it is meant that an entire hydraulic system is contained within each of the LRP and EDP. Thus, the hydraulic system in the LRP does not rely on hydraulic fluid from the surface or from the EDP. Likewise the hydraulic system in the EDP does not use hydraulic fluid from the LRP or surface.

An additional method of providing signals to the system 100 is through the use of acoustics. Surface control unit 2 may be provided with an acoustic transmitter 92. In one possible embodiment, utilizing acoustics to send a signal to the EDP 20 or LRP 10 may allow for control to be maintained at the surface when an umbilical or connection to the surface has been disconnected. In another possible embodiment, only EDP 20 may have an acoustic receiver capable of receiving signals sent from the acoustic transmitter of the surface control unit 2. EDP 20 may contain an acoustic receiver 94 which may be connected to subsea control module 54. In another possible embodiment, subsea control module 82 within LRP 10 may contain acoustic receiver 102. In the possible embodiments, each acoustic receiver 94, 102 are able to receive signals sent from the surface control unit 2. In another possible embodiment, the acoustic signal may also be used to control the LRP 10 when the EDP 20 is disconnected from the LRP 10.

The EDP 20 may be disconnected from the LRP 10 under some situations. This may be due to workovers, damage, maintenance, emergencies, or the like. When the EDP is disconnected from the LRP 10, the LRP is still operable to conduct operations. For instance, a remote operated vehicle (ROV) may be sent to the LRP 10 with an umbilical to connect to the LRP 10. The LRP 10 may be equipped with a connection point 122 (See FIG. 7) where the umbilical connection may be secured to send a signal from the surface control unit 2 thereby ensuring continued operation without the EDP 20.

Figure 7:
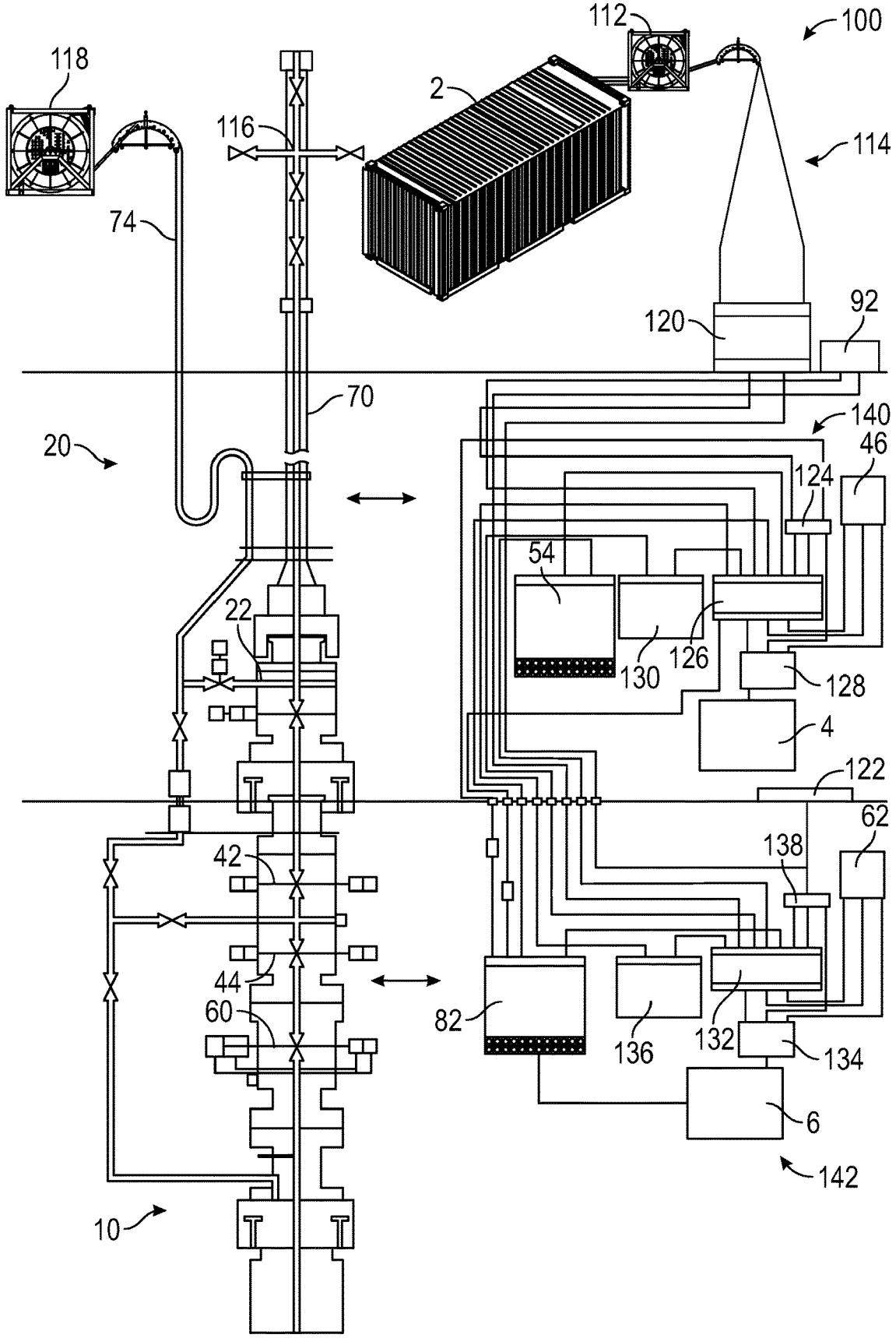
FIG. 7 is a schematic of a deepwater riser intervention system with the Lower Riser package and Emergency Disconnect package in accord with one embodiment of the present invention.

Looking to FIG. 7, a schematic view is shown of intervention system 100. LRP 10 and EDP 20 are mounted with separate control systems 142 and 140, respectively, whereby each can be controlled independently. The block diagram for these control systems may be as shown in FIG. 6. As discussed previously, these control systems are also connected to each other to work as backup in case of one system fails.

Control system 140 is operable to control all the functions within the EDP 20. Control system 140 comprises SCM 54 which is described above. Battery 46 provides power throughout the system and emergency backup in case connection to the surface is lost. Transformer canister 124 comprises transformers 26, 28. SDU 126 comprises junction boxes 30 and 32. Within each respective junction box are power supply modules 36, 50 and routers 38, 52. Hydraulic fluid is contained within a reservoir and circulated throughout EDP 20 with a pump housed within hydraulic power unit (HPU) 4. EDP 20 contains a supply of hydraulic fluid operable to controls the valves, gates, and the like without any supplemental supply provided from the surface. Therefore, the fluid is in a closed loop system wholly contained in EDP 20. EDP 20 utilizes sensors housed within sensor control unit 130 to determine the position of the valves, whether they are open or closed, whether accumulators have sufficient pressure, temperature and pressure, the location of the pipe, and the like. A variable speed drive 128 (VSD) can be utilized if desired.

Control system 142 is operable to control all the functions within the LRP 10. Control system 142 comprises SCM 82 which is described above. Battery 62 provides power throughout the system and emergency backup in case connection to the surface is lost. Transformer canister 138 comprises transformers within the canister. SDU 132 comprises junction boxes 86 and 88. Within each respective junction box are power supply modules 104, 108 and routers 106, 110. Hydraulic fluid is contained within a reservoir and circulated throughout LRP 10 with a pump housed within hydraulic power unit (HPU) 6. LRP 10 contains a supply of hydraulic fluid operable to controls the valves, gates, and the like without any supplemental supply provided from the surface, Therefore, the hydraulic fluid is in a closed loop system wholly contained within LRP 10, LRP 10 utilizes sensors housed within sensor control unit 136 to determine the position of the valves, whether they are open or closed, whether accumulators have sufficient pressure, temperature and pressure, the location of the pipe, and the like. A variable speed drive 134 (VSD) can be utilized if desired.

A plurality of sensors may be housed within the sensor control units 130, 136. A PT/TT sensor may measure pressure and temperature at the production and annulus bore. A PT TV-1 sensor may measure pressure at the test valve on the LRP. A PT AR-1 sensor may measure pressure at the regulator of the control circuit. A PT AR-C sensor may also measure pressure at the regulator of the control circuit. A flow meter (FM) may measure the flow rate from the HPUs. The sensors are all independent of whether the EDP is split/connected with the LRP.

DRS 100 is mounted with Acoustic control system 92 as a backup system for sending control signals in the event the umbilical line is no longer connected or operational. In one embodiment, only the EDP 20 is equipped with an acoustic receiver. The acoustic receiver may be utilized when the umbilical has lost connection from the surface control unit 2. The acoustic signal can be utilized to send signals to control system 100 in the scenario the umbilical is not or cannot be utilized. In another possible embodiment, both EDP 20 and LRP 10 can be controlled with acoustic control system 92 independently.

In one possible embodiment, a signal from the surface is required to operate EDP 20 or LRP 10. Neither package is equipped with programming to operate independently. However, as a failsafe in the case communication is lost from the topside to the LRP 10 and EDP 20, the system will go to safe mode after a specified time. Going into safe mode is automatic after the specified time. In safe mode, the well barriers, i.e., one or more of the valve cutters discussed hereinbefore, may be activated to close and seal the well. This may be the case in emergency situations where all communications have been lost to intervention system 100. In another possible embodiment, the EDP 20 and LRP 10 are equipped with programming to operate independently from the surface. Therefore, the EDP 20 or the LRP10 can continue pressure control operations without need for a signal for the surface.

The LRP 10 can be controlled independently from the EDP 20 when the EDP 20 is disconnected. The intervention system is equipped with an umbilical package 114. The umbilical package 114 may have an umbilical spool 112 to supply an umbilical line. An ROV may be dispatched to create a connection with an umbilical cable or line from umbilical termination head 120 to umbilical termination head connector 122. Therefore, operations can continue without the EDP 20 connected. The LRP 10 is equipped with its own supply of hydraulic fluid within HPU 6 and can still control the valves, gates, and the like when necessary. This will allow controlling of well barriers in case of emergency. It will be appreciated that in a preferred embodiment there are no hydraulic couplers between EDP 20 and LRP 10. Each package contains its own respective supply and pumps. Only an electrical feed through connects between each package. In a preferred embodiment, there is a 10° EDP disconnect angle with Annulus line 74 engaged to intervention system 100.

EDP 20 and LRP 10 are operable to control the emergency gates and valves, e.g. the previously discussed valve cutters when necessary. The system 100 comprises an annulus spool 118 with an annulus line 74 being sent down along with multiple riser tubes 70. At the surface there are a plurality of well valves 116 which can be controlled by surface unit 2. Intervention system 100 may equipped with a gate valve within EDP block 22. Within LRP 10, there are three additional well barriers: upper control valve 42, lower control valve 44, and compact cutting device 60 possible embodiments of which are discussed and described in more detail in the previously discussed patents. Each of these well barriers may be utilized to cut and seal any tubing, line, or the like within the well in the case the well must be shut. In a preferred embodiment, the well barriers are the gate valve cutters and the compact cutting system shown in the patents incorporated herein. These gate valve cutters include one or more gates like the gates of a gate valve that incorporate cutters therein. Gates are not the same as rams and instead have a flat portion that mates to an opening through the valve to seal the valve.

The foregoing disclosure and description of the invention is illustrative and explanatory thereof, and it will be appreciated by those skilled in the art, that various changes in the size, shape and materials as well as in the details of the illustrated construction or combinations of features of the various coring elements may be made without departing from the spirit of the invention. Moreover, the scope of this patent is not limited to its literal terms but instead embraces all equivalents to the claims described.

The invention claimed is:

1. A riser intervention system for subsea applications, a wellbore extending through said riser intervention system, comprising:

a surface control;

an emergency disconnect package with a first control, said first control comprising a first hydraulic power unit, said first hydraulic power unit comprising a first hydraulic fluid reservoir and a first hydraulic pump, said first control being electrically connectable to said surface control, a first battery for said first control to provide power when said first control is not electrically connected to said surface control, said first hydraulic fluid reservoir and said first hydraulic pump being a closed loop system that is not hydraulically connected to said surface control, a first well barrier for cutting and sealing functions on a first portion of said wellbore through said emergency disconnect package;

a lower riser package connectable to said emergency disconnect package, said lower riser package being selectively disconnectable from said emergency disconnect package, said lower riser package comprising a second control comprising a second hydraulic power unit, said second hydraulic power unit comprising a second hydraulic fluid reservoir and a second hydraulic pump, said second control being electrically connectable to said surface control and said first control, a second battery for said second control to provide power when said second control is not electrically connected to said surface control or said first control, said second hydraulic fluid reservoir and said second hydraulic pump being a closed loop system that is not hydraulically connected to said surface control or said first hydraulic power unit, second, third and fourth well barriers for cutting and sealing functions on a second portion of said wellbore through said lower riser package; and said emergency disconnect package and said lower riser package being connectable without using hydraulic couplers.

2. The riser intervention system of claim 1, further comprising an acoustic control system comprising a surface acoustic transmitter, a first acoustic receiver for said emergency disconnect package operable to send signals to said first control when said first control is not electrically connected to said surface control.

3. The riser intervention system of claim 1, further comprising an acoustic control system comprising a surface acoustic transmitter, a second acoustic receiver for said lower riser package operable to send signals to said second control when said second control is not electrically connected to said surface control.

4. The riser intervention system of claim 1, further comprising electrical feeds between said emergency disconnect package and said lower riser package when said emergency disconnect package is connected to said lower riser package.

5. The riser intervention system of claim 1 wherein said surface control is operable to selectively operate either said first control or said second control or both, said surface control is operable to operate said second control whether said emergency disconnect package is attached or not attached to said lower riser package.

6. The riser intervention system of claim 1 wherein when said emergency disconnect package is secured to said lower riser package then said first control can operate said second control or said second control can operate said first control.

7. The riser intervention system of claim 1 further comprising a first umbilical termination head to electrically connect said surface control to said first control.

8. The riser intervention system of claim 1 further comprising a second umbilical termination head to electrically connect said surface control to said second control.

9. The riser intervention system of claim 8, wherein an ROV is operable to connect an umbilical to said second umbilical termination head when said emergency disconnect package is separated from said lower riser package.

10. The riser intervention system of claim 1 further comprising a sensor control unit comprising at least one sensor of a pressure sensor, a temperature sensor, a flow meter, or a combination thereof.

11. The riser intervention system of claim 10 further comprising said at least one sensor is operable to operate whether or not the emergency disconnect package is connected to the lower riser package.

12. The riser intervention system of claim 1 further comprising said emergency disconnect package and said lower riser package comprise programming operable to operate said first control and said second control when no signal is received by said emergency disconnect package and said lower riser package from said surface control.

* * * * *